US010363677B2

(12) United States Patent
Tokuda

(10) Patent No.: US 10,363,677 B2
(45) Date of Patent: Jul. 30, 2019

(54) PRINTING APPARATUS AND CUTTER DEVICE

(71) Applicant: SEIKO EPSON CORPORATION, Tokyo (JP)

(72) Inventor: Takeshi Tokuda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/628,867

(22) Filed: Jun. 21, 2017

(65) Prior Publication Data

US 2018/0001500 A1 Jan. 4, 2018

(30) Foreign Application Priority Data

Jun. 29, 2016 (JP) ..... 2016-128615

(51) Int. Cl.

| | |
|---|---|
| ***B41J 11/70*** | (2006.01) |
| ***B26D 5/08*** | (2006.01) |
| ***B26D 1/38*** | (2006.01) |
| ***B26D 5/16*** | (2006.01) |
| *B26D 1/00* | (2006.01) |
| *B41J 11/66* | (2006.01) |

(52) U.S. Cl.

CPC ..... *B26D 5/083* (2013.01); *B26D 1/38* (2013.01); *B26D 5/16* (2013.01); *B26D 2001/0033* (2013.01); *B26D 2001/0053* (2013.01); *B41J 11/66* (2013.01); *B41J 11/706* (2013.01)

(58) Field of Classification Search

CPC . B26D 1/38; B26D 5/083; B26D 5/16; B26D 2001/0033; B26D 2001/0053; B41J 11/66; B41J 11/706

See application file for complete search history.

(56) References Cited

U.S. PATENT DOCUMENTS

| | | | | |
|---|---|---|---|---|
| 8,152,394 | B2 | 4/2012 | Kohira et al. | |
| 2001/0017713 | A1 | 8/2001 | Shinohara | |
| 2009/0317163 | A1 | 12/2009 | Kohira et al. | |
| 2010/0202819 | A1* | 8/2010 | Shirotori | B26D 1/085 400/621 |
| 2016/0185139 | A1 | 6/2016 | Ishida et al. | |

FOREIGN PATENT DOCUMENTS

| | | | | |
|---|---|---|---|---|
| CN | 101607487 | A | 12/2009 | |
| JP | 05-318385 | A | 12/1993 | |
| JP | 2016124073 | * | 4/2016 | B26D 1/08 |
| JP | 2016-120559 | A | 7/2016 | |

* cited by examiner

*Primary Examiner* — Matthew G Marini
*Assistant Examiner* — Marissa Ferguson-Samreth
(74) *Attorney, Agent, or Firm* — Workman Nydegger

(57) ABSTRACT

A printing apparatus includes a cutter. The cutter includes a first blade and a second blade, and cuts a printing medium by causing the first blade to be in frictional contact with the rotatable second blade to be moved, in which a rotation center of the second blade is disposed on a first blade side with respect to a moving surface of the first blade.

10 Claims, 6 Drawing Sheets

PRINTING APPARATUS AND CUTTER DEVICE

BACKGROUND

1. Technical Field

The present invention relates to a printing apparatus including a cutter for cutting a printing medium by causing a moving blade to be in frictional contact (slide) with a fixed blade, or the like, and particularly, to a printing apparatus capable of effectively preventing biting between the fixed blade and the moving blade, or the like.

2. Related Art

In the related art, there is a printer including a cutter for cutting a sheet with a fixed blade and a moving blade. Such a cutter includes the fixed blade capable of being slightly moved by a rotating motion even while being biased toward the moving blade. In this case, in order to prevent biting (locking) between the fixed blade and the moving blade, a blade edge of the fixed blade is tapered.

In JP-A-5-318385, a cutter in which a releasing mechanism of a movable blade and a fixed blade is provided in order to prevent occurrence of noise is described.

However, in a case where a blade edge is too sharp in the cutter described above, or the like, a force of the movable blade in a moving direction may act on the fixed blade irrespective of the taper of the blade edge. In such a case, the fixed blade may rotate in a direction opposite to a direction in which the fixed blade escapes from the moving blade depending on a position of a rotation axis of the rotating operation of the fixed blade. In this case, there is a concern that the fixed blade and the moving blade may bite (lock).

In JP-A-5-318385, no effective solution is disclosed for this problem.

SUMMARY

An advantage of some aspects of the invention is to provide a printing apparatus including a cutter for cutting a printing medium by causing a moving blade to be in frictional contact with a fixed blade and capable of effectively preventing biting between the fixed blade and the moving blade, or the like.

According to an aspect of the invention, there is provided a printing apparatus including: a cutter which includes a first blade and a second blade, and cuts a printing medium by causing the first blade to be in frictional contact with the rotatable second blade to be moved, in which a rotation center of the second blade is disposed on a first blade side with respect to (regarding) a moving surface of the first blade.

According to the aspect, even if a force of the first blade in the moving direction acts on the second blade when the first blade is in contact with the second blade due to a cause that the blade edge is too sharp, a rotational moment acts on the second blade in a direction away from the first blade, and the second blade and the first blade do not bite (do not lock). Furthermore, since the first blade and the second blade do not bite, the blade edge can be made sharp and it is possible to make the cutter which can cut well.

Furthermore, in the printing apparatus, it is preferable that the second blade be biased in a direction in which the second blade is in contact with the first blade.

According to the aspect, the second blade is biased toward the first blade side during cutting and it is possible to reliably cut the printing medium.

Furthermore, in the printing apparatus, it is preferable that the printing apparatus be capable of being installed in two orientations that differ by substantially 90 degrees.

According to the aspect, it is possible to provide the printing apparatus with high convenience.

According to another aspect of the invention, there is provided a cutting device including a first blade and a second blade, and cutting a medium by causing the first blade to be in frictional contact with the rotatable second blade to be moved, in which a rotation center of the second blade is disposed on a first blade side with respect to (regarding) a moving surface of the first blade.

According to still another aspect of the invention, there is provided a cutting device including a first blade and a second blade, and cutting a sheet by causing the first blade to be in cooperation with the second blade by being moved (slid on the second blade) with respect to the second blade, the device including: a support mechanism which supports the second blade so as to be swingable between a first position in which a blade portion side (blade edge side) of the second blade is in contact with the first blade and a second position in which the blade portion side of the second blade is away from the first blade. A swing center (swing fulcrum, swig axis) of the second blade is provided on a side opposite to the second position with respect to a position (contact position) where the first blade moves in a direction toward the second blade and a blade portion (blade edge) of the first blade abuts against a blade portion (blade edge) of the second blade.

In the configuration, the cutting device may further include a moving mechanism that causes the first blade to reciprocate with a standby position as a starting point; and a displacement mechanism that positions the second blade at the first position during a forward movement of the first blade and positions the second blade at the second position during a rearward movement of the first blade.

In addition, in the configuration, the support mechanism may include a biasing member that biases the second blade toward the first position. The displacement mechanism may position the second blade at the first position by a biasing force of the biasing member during the forward movement of the first blade and position the second blade at the second position against the biasing force of the biasing member during the rearward movement of the first blade.

In addition, in the configuration, the displacement mechanism may include a cam provided on a part of the moving mechanism causing the first blade to reciprocate, and a cam follower provided on a part of the support mechanism supporting the second blade. The second blade may be positioned at the second position by the cam and the cam follower.

In addition, in the configuration, the cutting device may further include a first blade biasing member that biases the first blade toward the standby position.

According to still another aspect of the invention, there is provided a printing apparatus that performs printing on continuous paper, the apparatus including: the cutting device having the configuration described above, in which the continuous paper is cut by the cutting device.

According to still another aspect of the invention, there is provided a cutting device which cuts a sheet by causing a first blade to be in cooperation with a second blade by being moved with respect to the second blade, the cutting device including: a support mechanism which supports the second blade so as to be swingable between a first position in which a blade portion side (blade edge side) of the second blade is in contact with the first blade and a second position in which the blade portion side of the second blade is away from the first blade. A swing center of the second blade is provided on a side in a direction from the second position toward the first position with respect to a position where the first blade moves in a direction toward the second blade and a blade portion (blade edge) of the first blade abuts against a blade portion (blade edge) of the second blade.

According to still another aspect of the invention, there is provided a cutting device which cuts a sheet by causing a first blade to be in cooperation with a second blade by being moved with respect to the second blade, the cutting device including: a support mechanism which supports the second blade so as to be swingable between a first position in which a blade portion (blade edge) side of the second blade is in contact with the first blade and a second position in which the blade portion side of the second blade is away from the first blade. A swing center of the second blade is provided at a position where the first blade moves in a direction toward the second blade and when a blade portion (blade edge) of the first blade abuts against a blade portion (blade edge) of the second blade, the second blade is swingable toward the second position by a force acting on the second blade.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings. Such an embodiment does not limit the technical scope of the invention described in the claims.

Figure 1:
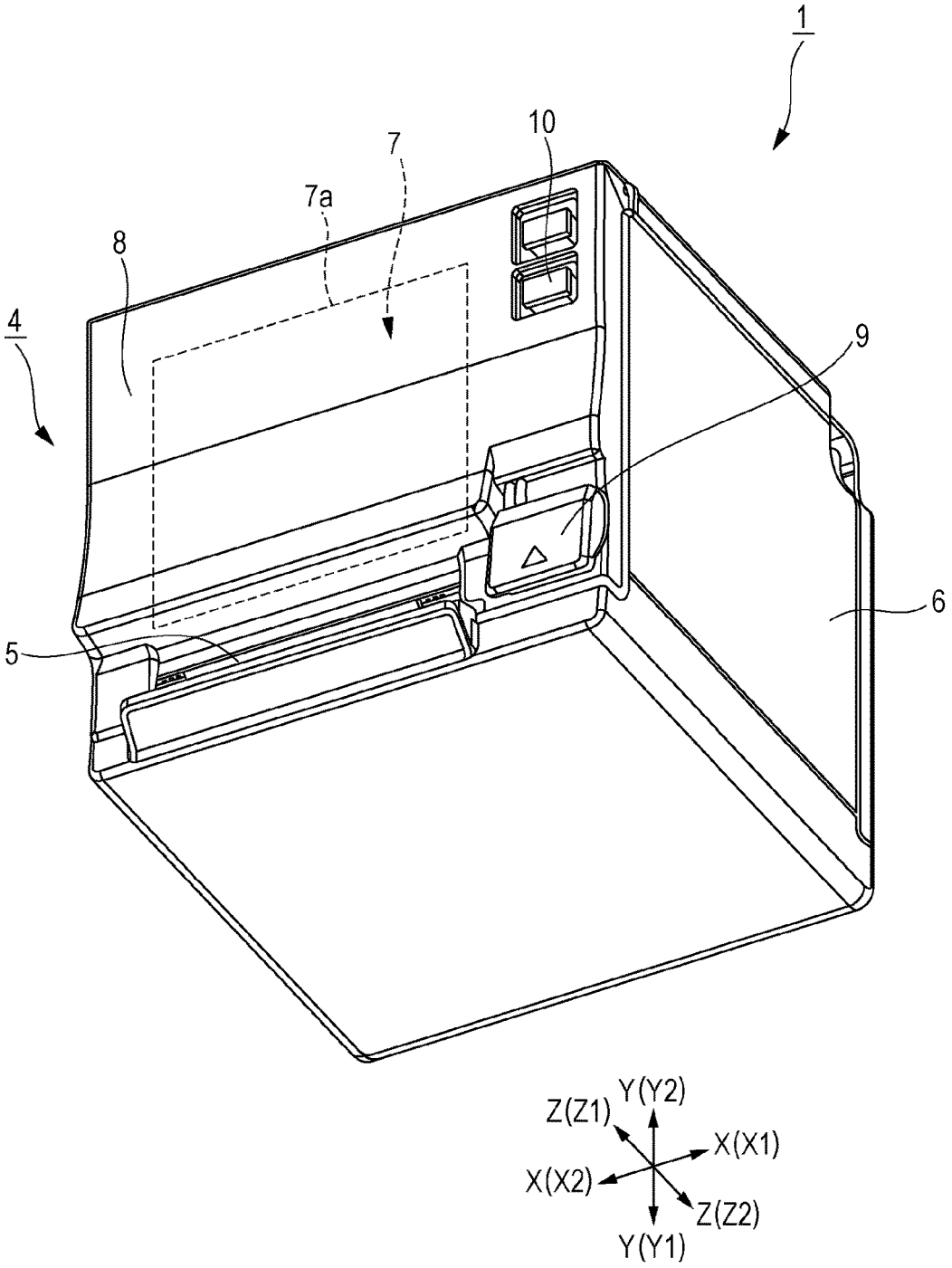
FIG. 1 is an external perspective view of a printing apparatus according to an embodiment to which the invention is applied.

FIG. 1 is an external perspective view of a printing apparatus according to the embodiment to which the invention is applied. A printer 1 that is a printing apparatus to which the invention is applied includes a cutter 15 (cutter device, cutting device) for cutting a recording paper 3 (printing medium) by causing a first cutter blade 21 (moving blade, or first blade) to be in frictional contact (sliding) with a second cutter blade 22 (fixed blade, or second blade). In the cutter 15, it is possible to effectively prevent biting between the first cutter blade 21 and the second cutter blade 22 by positioning a rotation center C of the second cutter blade 22 on a first cutter blade 21 side with respect to a moving surface of the first cutter blade 21. Moreover, the second cutter blade 22 is rotatably supported so that a blade portion 22*b* (blade edge 22*a*) side thereof moves between a position (sliding contact position 22A) against which the first cutter blade 21 abuts and a position (separated position 22B) from which the first cutter blade 21 is away.

As an example, the printer 1 is a receipt printer used in a cashier or the like of a shop, a roll paper 2 (continuous paper) is used as the printing medium, and a thermal method is adopted as a printing method.

Entire Configuration

The printer 1 is a roll paper printer performing printing on the long recording paper 3 fed from a roll portion of the roll paper 2. As illustrated in FIG. 1, the printer 1 includes a printer case 4 having a substantially rectangular parallelepiped shape as a whole. A discharge port 5 for discharging the recording paper 3 is provided on a front portion of an upper surface of the printer case 4. The discharge port 5 extends in a width direction of the printer 1. Hereinafter, three directions orthogonal to each other, that is, the width direction of the printer is referred to as an X direction, a forward and rearward direction of the printer is referred to as a Y direction, and an upward and downward direction of the printer is referred to as a Z direction. In addition, in the following description, in the width direction, a rightward direction is referred to as an X1 direction, a leftward direction is referred to as an X2 direction, in the forward and rearward direction, a forward direction is referred to as a Y1 direction, a reward direction is referred to as a Y2 direction, in the upward and downward direction, an upward direction is referred to as a Z1 direction, and a downward direction is referred to as a Z2 direction.

The printer case 4 includes a box-shaped case body 6 and an opening/closing door 8 which covers the case body 6 from above. The case body 6 includes a roll paper storage portion 7 on an inside thereof and the opening/closing door 8 blocks a roll portion insertion port 7*a* of the roll paper storage portion 7 from above (Z direction).

The opening/closing door 8 is provided on a rear side (side in the Y2 direction) of the discharge port 5. An opening/closing button 9 is provided at a right side end portion (end portion on a side of the X1 direction) of the opening/closing door 8. A power supply switch 10 is provided at a rearward end portion (end portion on a side in the Y2 direction) of the opening/closing button 9. When operating the opening/closing button 9, it is possible to release lock of the opening/closing door 8. When releasing the lock, the opening/closing door 8 can be rotated around a rotation axis extending in the width direction (X direction) at a rear end portion (end portion on a side in the Y2 direction) thereof. The opening/closing door 8 moves between a blocking position 8A for blocking the roll paper storage portion 7 in a state of being in a flattened state as illustrated in FIG. 1 and an open position 8B at which the roll paper storage portion 7 is in an opened state in a standing posture as indicated by a dotted line in FIG. 2. The printer 1 can be used by changing an installation direction by substantially 90 degrees and it is also possible to use an installation angle (posture) where the discharge port 5 faces in the Y2 direction of FIG. 1 in addition to the installation direction (posture) illustrated in FIG. 1. More specifically, the printer 1 can be used in a posture rotated substantially 90 degrees in the Y2 direction from the posture illustrated in FIG. 1 with the width direction X as the rotation axis.

Figure 2:
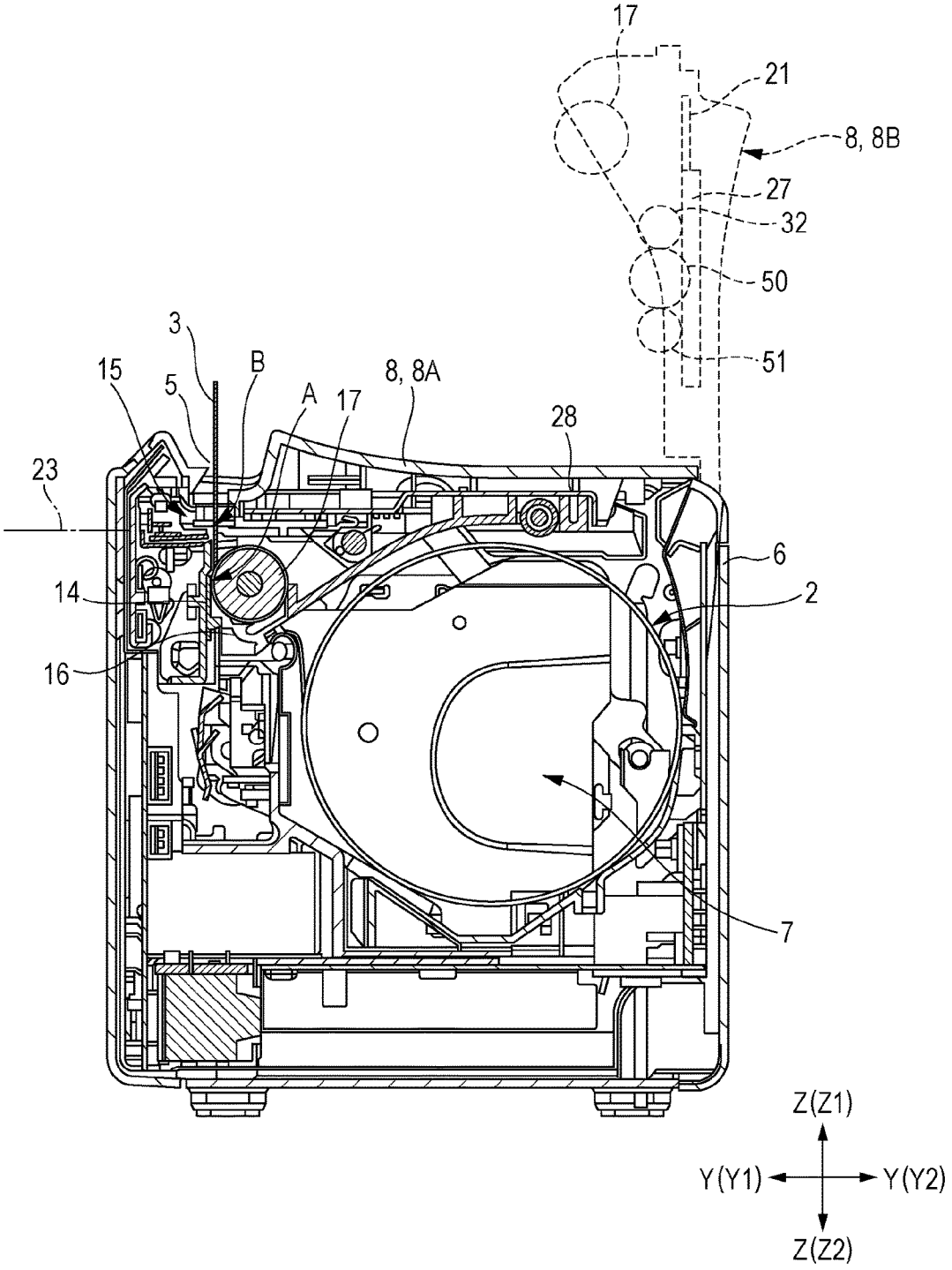
FIG. 2 is a schematic sectional view of the printing apparatus.

FIG. 2 is a schematic sectional view of the printing apparatus. As illustrated in FIG. 2, a print head 14 and the cutter 15 are mounted on an inside of the printer case 4. In addition, a transport path 16 of the recording paper 3 from the roll paper storage portion 7 to the discharge port 5 via a print position A by the print head 14 and a cutting position B by the cutter 15 in this order is provided on the inside of the printer case 4.

The print head 14 of the embodiment is a thermal head. The print position A is defined by a platen roller 17 facing the print head 14. A rotational driving force of a transport motor (not illustrated) is transmitted to the platen roller 17. A transmission mechanism (not illustrated) such as the platen roller 17, the transport motor, and a gear train for transmitting the driving force of the transport motor to the platen roller 17 configures a transport mechanism for transporting the recording paper 3 along the transport path 16.

A control portion (not illustrated) provided in the printer 1 drives the transport motor to rotate the platen roller 17 and transports the recording paper 3 drawn out from the roll portion of the roll paper 2 at a constant speed along the transport path 16. In addition, the control portion drives the print head 14 to print on the recording paper 3 transported at the print position A. Furthermore, the control portion drives the cutter 15 to cut a printed portion from the recording paper 3 (roll paper 2).

The control portion provided in the printer 1 has a CPU, a memory such as a ROM or a RAM, and an electric circuit such as a driver, and the CPU executes a program to control each portion of the printer 1.

Cutter

Figure 3:
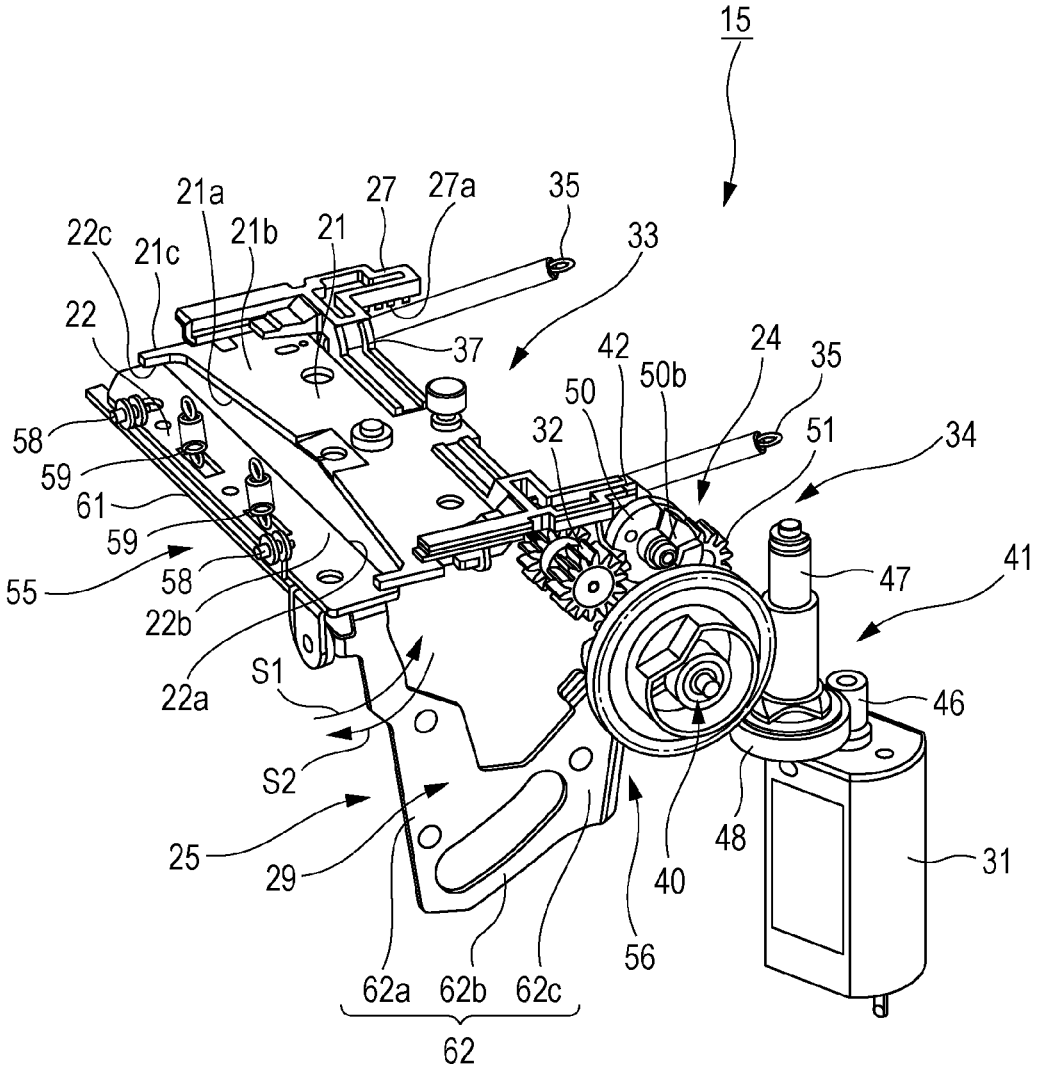
FIG. 3 is a perspective view of a cutter device.
Figure 3:
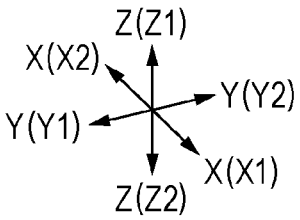
Figure 4:
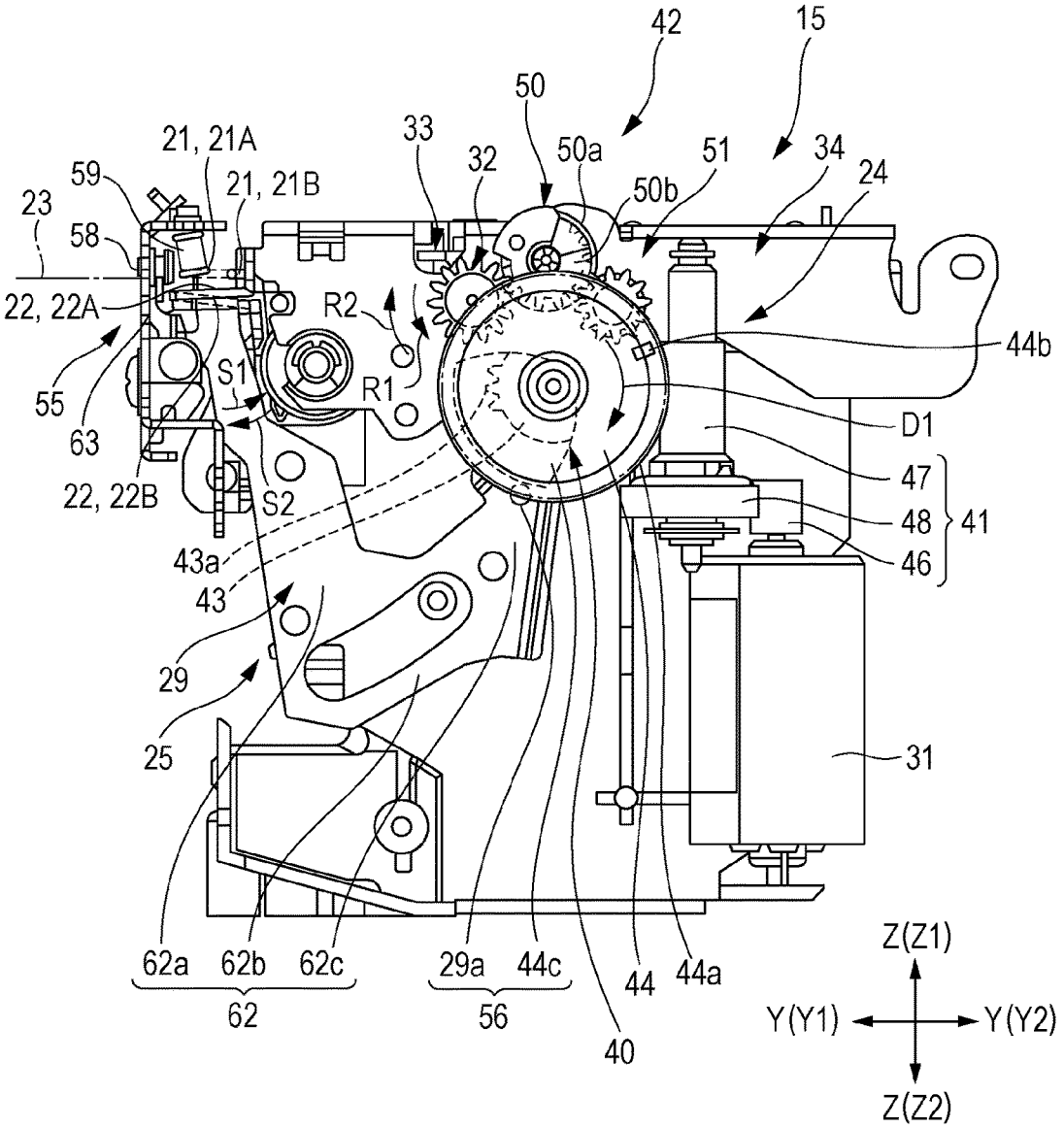
FIG. 4 is a side view of the cutter device.

FIG. 3 is a perspective view of the cutter device and FIG. 4 is a side view of the cutter device. As illustrated in FIG. 3, the cutter 15 includes a first cutter blade 21 and a second cutter blade 22 that cuts the recording paper 3 together with the first cutter blade 21. In addition, the cutter 15 includes a first cutter blade moving mechanism 24 that moves the first cutter blade 21 along a preset virtual plane (see FIG. 2, hereinafter, referred to as a moving surface 23). The moving surface 23 is a surface intersecting the transport path 16 at the cutting position B and in the embodiment, is orthogonal to the upward and downward direction (Z direction) below (Z2 direction) the discharge port 5. As illustrated in FIG. 4, the first cutter blade moving mechanism 24 causes the first cutter blade 21 to reciprocate between an advancing position 21A for cutting the recording paper 3 and a retracted position 21B (standby position) away from the advancing position 21A rearward (Y2 direction). A virtual plane including a moving trajectory of the first cutter blade 21 is the moving surface 23. Moreover, the moving trajectory of the first cutter blade 21 includes a trajectory when the first cutter blade 21 moves at least from the retracted position 21B to the advancing position 21A. As described above, the cutter 15 of the embodiment is configured such that the first cutter blade 21 moves in parallel with respect to the second cutter blade 22.

In addition, the cutter 15 has a second cutter blade moving mechanism 25 which is swung between the frictional contact position 22A (first position) at which the second cutter blade 22 abuts against the first cutter blade 21 to cut the recording paper 3 in cooperation with the first cutter blade 21 and the separated position 22B (second position) which is away from the first cutter blade 21 (moving surface 23).

The first cutter blade 21 moves from the retracted position 21B to the advancing position 21A and thereby the cutter 15 cuts the recording paper 3 on the transport path 16 at the cutting position B in a state where the second cutter blade 22 is disposed at the frictional contact position 22A. As described above, the recording paper 3 is cut during the rearward movement when the first cutter blade 21 moves from the retracted position toward the second cutter blade 22.

First Cutter Blade and Second Cutter Blade

As illustrated in FIG. 3, the first cutter blade 21 has a blade edge 21*a* facing forward Y1. The first cutter blade 21 is in a form of a plate and has a planar shape that is symmetrical laterally (symmetrical in the X direction when viewed from the Z direction). The first cutter blade 21 includes a V-shaped blade portion 21*b* of which a center in the width direction X is retracted rearward Y2. In addition, the first cutter blade 21 includes a pair of ride-up portions 21*c* protruding forward Y1 at both end portions of the blade portion 21*b* in the width direction X. Each ride-up portion 21*c* extends to a position overlapping both end portions (ridden-up portions 22*c*) in the width direction X in the second cutter blade 22 at the retracted position 21B when viewed in the upward and downward direction Z. A rear side portion of the first cutter blade 21 is supported by a rack member 27. In addition, the first cutter blade 21 and the rack member 27 are supported by a door-side frame 28 fixed to the opening/closing door 8 in a state of being movable in the forward and rearward direction Y.

The second cutter blade 22 has a blade edge 22*a* facing rearward Y2. The second cutter blade 22 is in a form of a plate and includes a substantially rectangular planar shape that is long in the width direction X. On an upper surface (surface on a side in the Z1 direction) of the second cutter blade 22, the ride-up portions 21*c* of the first cutter blade 21 include the frictional contactable ridden-up portions 22*c* at the both end portions in the width direction X on the rearward Y2 side (side facing the first cutter blade 21). A blade portion 22*b* of the second cutter blade 22 extends linearly between the ridden-up portions 22*c* in the width direction X of the printer. The second cutter blade 22 is mounted (supported) on a support frame 29 on a case body 6 side.

First Cutter Blade Moving Mechanism

As illustrated in FIG. 3, the first cutter blade moving mechanism 24 has a driving motor 31 as a driving source, a driving gear 32, a rotation/linear motion conversion mechanism 33 which converts the rotation of the driving gear 32 into the linear motion to retract the first cutter blade 21 along the moving surface 23, and a transmission mechanism 34 which transmits the rotation of the driving motor 31 to the driving gear 32. In addition, the first cutter blade moving mechanism 24 has coil springs 35 (first blade biasing member) for biasing the first cutter blade 21 from an advancing position 21A side to an retracted position 21B side.

The rotation/linear motion conversion mechanism 33 is a rack and pinion mechanism in the embodiment. That is, the rotation/linear motion conversion mechanism 33 has a pinion 37 which is disposed coaxially with the driving gear 32 and rotates integrally therewith, a rack 27*a* provided in the rack member 27 supporting the first cutter blade 21. The pinion 37 meshes with the rack 27*a*. The driving motor 31 is, for example, a DC motor and is rotationally driven by the control portion. Here, the driving gear 32 is rotated by a specified rotation angle in a first rotating direction R1 (see FIG. 4) so that the rotation/linear motion conversion mechanism 33 moves the first cutter blade 21 from the retracted position 21B to the advancing position 21A. In addition, the driving gear 32 is rotated by a specified rotation angle in a second rotating direction R2 (see FIG. 4) opposite to the first rotating direction R1 so that the rotation/linear motion conversion mechanism 33 moves the first cutter blade 21 from the advancing position 21A to the retracted position 21B.

The transmission mechanism 34 includes a compound gear (intermittent gear) 40, an upstream side transmission mechanism 41 which is positioned on an upstream side of the compound gear 40 in a transmission path of the rotation of the driving motor 31, and a downstream side transmission mechanism 42 which is positioned on a downstream side of the compound gear 40. As described below, the first cutter blade 21 reciprocates one time between the advancing position 21A and the retracted position 21B from the retracted position 21B as a starting point while the compound gear 40 is rotated one revolution in one direction (D1 direction illustrated in FIG. 4) by the drive of the driving motor 31.

The compound gear 40 is disposed with a rotation axis thereof facing the X direction below (Z2 direction) the moving surface 23 of the first cutter blade 21. As illustrated in FIG. 4, the compound gear 40 includes an intermittent gear portion 43 having an intermittent tooth portion (tooth portion) 43*a* formed in a predetermined angle range, a large diameter gear portion 44 which has a larger diameter than that of the intermittent gear portion 43 and is formed coaxially with the intermittent gear portion 43. The large diameter gear portion 44 is positioned on a side (outside) in the X1 direction of the intermittent gear portion 43.

The large diameter gear portion 44 includes a tooth portion 44*a* over an entire circumference thereof. In addition, the large diameter gear portion 44 includes a compound gear-side protrusion (abutting portion) 44*b* protruding the side in the X2 direction at an end surface on an intermittent gear portion 43 side (side in the X2 direction). The compound gear-side protrusion 44*b* is provided at an angular position (position in a circumferential direction) different from the intermittent tooth portion 43*a* on an outer peripheral side of the intermittent tooth portion 43*a* of the intermittent gear portion 43. In addition, the compound gear-side protrusion 44*b* extends in the circumferential direction and has a dimension over a predetermined angle range.

Furthermore, the compound gear 40 includes a cam 44*c*. The cam 44*c* is formed integrally with the intermittent tooth portion 43*a* and the large diameter gear portion 44. The cam 44*c* and the compound gear-side protrusion 44*b* of the large diameter gear portion 44 are provided at different angular positions (positions in the circumferential direction).

The upstream side transmission mechanism 41 includes a pinion 46 attached to a rotation axis of the driving motor 31, a worm 47 to which the rotation of the pinion 46 is transmitted, and a clutch mechanism 48 provided between the worm 47 and the pinion 46. The driving motor 31 and the worm 47 are disposed in a state where each rotation axis thereof faces the Z direction. The worm 47 meshes with the tooth portion 44*a* of the large diameter gear portion 44 in the compound gear 40. The clutch mechanism 48 cuts a transmission path between the worm 47 and the pinion 46 in a case where a large rotational force is input from a downstream side to an upstream side of the transmission path, or the like. The first cutter blade moving mechanism 24 can be prevented from being damaged by providing the clutch mechanism 48.

The downstream side transmission mechanism 42 has a cutter blade returning gear 50 meshing with the driving gear 32 and a transmission gear 51 transmitting the rotation of the compound gear 40 to the cutter blade returning gear 50. The driving gear 32, the cutter blade returning gear 50, and the transmission gear 51 are disposed in this order rearward (Y2 direction) above (Z1 direction) the intermittent gear portion 43 of the compound gear 40. The rotation axis of the driving gear 32 is positioned forward (Y1 direction) the rotation axis of the compound gear 40 and the rotation axis of the transmission gear 51 is positioned rearward (Y2 direction) the rotation axis of the compound gear 40.

The transmission gear 51 can mesh with the intermittent tooth portion 43*a* of the compound gear 40 (intermittent gear portion 43). The cutter blade returning gear 50 is an intermittent gear. An intermittent tooth portion 50*a* of the cutter blade returning gear 50 meshes with both the driving gear 32 and the transmission gear 51. Moreover, the cutter blade returning gear 50 can be a normal gear having teeth on an entire circumference.

The cutter blade returning gear 50 includes a cutter blade returning protrusion 50*b* at a position away from the rotation axis thereof in a radial direction. The cutter blade returning protrusion 50*b* has a sector shape extending outward in the circumferential direction. An essential portion of the sector shape coincides with the rotation axis of the cutter blade returning gear 50.

The cutter blade returning protrusion 50*b* can abut against the compound gear-side protrusion 44*b* of the compound gear 40. That is, a circular moving path in which the cutter blade returning protrusion 50*b* moves while the cutter blade returning gear 50 rotates one revolution and a circular moving path in which the compound gear-side protrusion 44*b* of the compound gear 40 moves while the compound gear 40 rotates one revolution are partially overlapped. Therefore, the compound gear-side protrusion 44*b* of the compound gear 40 abuts against the cutter blade returning protrusion 50*b* only for a predetermined period to move the cutter blade returning protrusion 50*b* in a rotating direction D1 of the compound gear 40 while the compound gear 40 rotates one revolution. Moreover, the period during which the compound gear-side protrusion 44*b* of the compound gear 40 abuts against the cutter blade returning protrusion 50*b* is a period in which meshing between the transmission gear 51 and the intermittent tooth portion 43*a* of the compound gear 40 is released. The compound gear-side protrusion 44*b* of the compound gear 40 does not abut against the cutter blade returning protrusion 50*b* while the transmission gear 51 meshes with the intermittent tooth portion 43*a* of the compound gear 40.

Here, the rotation of the compound gear 40 is transmitted from the transmission gear 51 to the driving gear 32 via the cutter blade returning gear 50 during the period in which the intermittent tooth portion 43*a* of the compound gear 40 meshes with the transmission gear 51 while the compound gear 40 to which the rotation of the driving motor 31 is transmitted rotates one revolution. Therefore, the driving gear 32 rotates by a specified rotation angle in the first rotating direction R1. As a result, the first cutter blade 21 moves from the retracted position 21B to the advancing position 21A.

On the other hand, the rotation of the compound gear 40 is transmitted to the cutter blade returning gear 50 via the compound gear-side protrusion 44*b* and the cutter blade returning protrusion 50*b* during the period in which the compound gear-side protrusion 44*b* of the compound gear 40 abuts against the cutter blade returning protrusion 50*b* of the cutter blade returning gear 50 in a state where meshing between the intermittent tooth portion 43*a* of the compound gear 40 and the transmission gear 51 is released while the compound gear 40 to which the rotation of the driving motor 31 is transmitted rotates one revolution. Therefore, the cutter blade returning gear 50 is rotated along with the compound gear 40 and the cutter blade returning gear 50 rotates in a rotating direction opposite to a case where the rotation of the compound gear 40 is transmitted via the transmission gear 51. As a result, the driving gear 32 is rotated by a specified rotation angle in the second rotating direction R2 during the period in which the compound gear-side protrusion 44*b* abuts against the cutter blade returning protrusion 50*b*. Therefore, the first cutter blade 21 returns from the advancing position 21A to the retracted position 21B.

A pair of coil springs 35 is disposed to be separated in the X direction and extends in the Y direction. Each coil spring 35 is configured such that a front end portion (end portion on one side) is attached to the rack member 27 and a rear end portion (end portion on the other side) is attached to the door-side frame 28. Each coil spring 35 expands and accumulates a biasing force as the first cutter blade 21 moves from the retracted position 21B to the advancing position 21A. That is, the first cutter blade moving mechanism 24 moves the first cutter blade 21 from the retracted position 21B to the advancing position 21A against the biasing force of each coil spring 35. In addition, each coil spring 35 assists the movement of the first cutter blade 21 to the retracted position 21B by the accumulated biasing force when the first cutter blade moving mechanism 24 moves the first cutter blade 21 from the advancing position 21A to the retracted position 21B.

Here, the platen roller 17, the downstream side transmission mechanism 42 (transmission gear 51 and the cutter blade returning gear 50) of the first cutter blade moving mechanism 24, the driving gear 32, the rack member 27, the first cutter blade 21, and the coil springs 35 are supported by the door-side frame 28. Therefore, the platen roller 17, the downstream side transmission mechanism 42, the driving gear 32, the rack member 27, the first cutter blade 21, and the coil springs 35 are separated from the case body 6 by being rotated together with the opening/closing door 8 when opening the opening/closing door 8 (see FIG. 2).

Second Cutter Blade Moving Mechanism

As illustrated in FIG. 4, the second cutter blade 22 is in an inclined posture which is inclined in a direction (Z1 direction) approaching the moving surface 23 of the first cutter blade 21 toward (toward the Y2 direction) the first cutter blade 21 at the frictional contact position 22A at which the second cutter blade 22 is capable of being in frictional contact with the first cutter blade 21. In the inclined posture, the blade edge 22*a* of the second cutter blade 22 is on the moving surface 23. The blade edge 22*a* is displaced in the downward direction (Z2 direction) away from the moving surface 23 more than the inclined posture so that the second cutter blade moving mechanism 25 moves the second cutter blade 22 from the frictional contact position 22A to the separated position 22B.

As illustrated in FIGS. 3 and 4, the second cutter blade moving mechanism 25 includes a support mechanism 55 which swingably (rotatably) supports the second cutter blade 22 around the rotation center C (see FIG. 6), and a link mechanism 56 (displacement mechanism) which causes the second cutter blade 22 to be swung by the first cutter blade moving mechanism 24 in synchronization with the movement of the first cutter blade 21.

The support mechanism 55 includes the support frame (support member) 29 on which the second cutter blade 22 is mounted, a stopper member 58 which swingably (rotatably) connects (couples) the support frame 29 (cutter support portion 61 of the support frame 29) to a body frame 63, and coil springs 59 (biasing member) which biases the second cutter blade 22 to the frictional contact position 22A (in the Z1 direction) by biasing the support frame 29. In the embodiment, two coil springs 59 are provided on an upper surface side of the second cutter blade 22 as the biasing member.

As illustrated in FIG. 3, the support frame 29 has the cutter support portion 61 and a link frame portion 62. The cutter support portion 61 and the link frame portion 62 may be integrally formed, may be formed as separate bodies, or may be connected by screws or the like.

The cutter support portion 61 extends in the X direction and supports the second cutter blade 22 from below. The cutter support portion 61 is a substantially rectangular planar member and a front end portion (end portion on the side in the Y1 direction) thereof is bent upward by approximately 90 degrees.

The link frame portion 62 is a substantially U-shaped planar member extending downward (Z2 direction) from the end portion of the cutter support portion 61 on the side in the X1 direction. The link frame portion 62 includes a front side frame portion 62*a* extending downward Z2, an intermediate frame portion 62*b* extending rearward Y2 from a lower end portion of the front side frame portion 62*a*, and a rear side frame portion 62*c* extending upward Z1 from a rear end portion of the intermediate frame portion 62*b*. A cam follower portion 29*a* capable of abutting against the cam 44*c* of the compound gear 40 is provided at an upper end portion of the rear side frame portion 62*c*.

The coil spring 59 biasing the second cutter blade 22 to the frictional contact position 22A biases the support frame 29 in a direction (counterclockwise direction) indicated by arrow S1 in FIGS. 3 and 4. Therefore, the coil spring 59 biases the cam follower portion 29*a* in a direction in which the cam follower portion 29*a* is in contact with the cam 44*c*.

The stopper member 58 is a portion that connects an upper end of the front end portion (bent portion) of the cutter support portion 61 to the body frame 63 and in the embodiment, two stopper members are provided at both end portions in the width direction X. Each stopper member 58 has a shape in which two collars (discloses having a larger diameter than that of a cylindrical shaft) are attached to the cylindrical shaft, and one end of the cylindrical shaft is fixed to the frame 63. In each stopper member 58, the upper end of the front end portion of the cutter support portion 61 is inserted between the two collars.

The support frame 29 can swing with the upper end of the front end portion of the cutter support portion 61 inserted between the collars of the stopper member 58 as the rotation center C. Since the second cutter blade 22 is fixed to the cutter support portion 61 of the support frame 29, the second cutter blade 22 swings (rotates) as the support frame 29 swings. As described above, the rotation center C of the second cutter blade 22 is provided on a side (side in the Y1 direction) facing the blade edge 22*a* of the second cutter blade 22.

One end of the coil spring 59 is fixed to the body frame 63, the other end thereof is fixed to the forward Y1 side (side opposite to the blade edge 22*a*) of the second cutter blade 22 or to the forward Y1 side of the cutter support portion 61, and the coil spring 59 biases the second cutter blade 22 upward (frictional contact position 22A).

The cam follower portion 29*a* of the support frame 29 and the cam 44*c* of the compound gear 40 configure the link mechanism 56. The support frame 29 is rotated by the cam 44*c* in accordance with the movement (rotation of the compound gear 40) of the first cutter blade 21 and thereby the link mechanism 56 moves the second cutter blade 22 between the frictional contact position 22A and the separated position 22B.

More specifically, the support frame 29 is biased in the S1 direction by the coil spring 59 during a period in which the cam follower portion 29*a* does not abut against the cam 44*c* of the compound gear 40 while the compound gear 40 rotates one revolution. Therefore, the ridden-up portion 22*c* of the second cutter blade 22 abuts against the ride-up portion 21*c* of the first cutter blade 21 from below. Therefore, the second cutter blade 22 is disposed at the frictional contact position 22A at the inclined posture. In addition, the second cutter blade 22 is pressed against the first cutter blade 21 by the biasing force of the coil spring 59 in a state of being disposed at the frictional contact position 22A.

On the other hand, when the compound gear 40 rotates and thereby the cam follower portion 29*a* of the support frame 29 abuts against the cam 44*c* of the compound gear 40, the rear side frame portion 62*c* is displaced downward Z2 against the biasing force of the coil spring 59. Therefore, the support frame 29 rotates in the S2 direction (clockwise direction) indicated by the arrow in FIGS. 3 and 4. As a result, the blade edge 22*a* is separated from the moving surface 23 downward Z2 and the second cutter blade 22 is disposed at the separated position 22B at which the second cutter blade 22 is not in frictional contact with the first cutter blade 21. The second cutter blade 22 is disposed at the separated position 22B during the period in which the cam follower portion 29*a* abuts against the cam 44*c*.

Here, the second cutter blade moving mechanism 25 disposes the second cutter blade 22 at the frictional contact position 22A before the first cutter blade moving mechanism 24 moves the first cutter blade 21 from the retracted position 21B to the advancing position 21A. In addition, the second cutter blade moving mechanism 25 disposes the second cutter blade 22 at the separated position 22B before the first cutter blade moving mechanism 24 moves the first cutter blade 21 from the advancing position 21A to the retracted position 21B.

That is, during the forward movement in which the first cutter blade 21 moves toward the advancing position 21A, the second cutter blade 22 is positioned at the frictional contact position 22A and during the rearward movement in which the first cutter blade 21 moves toward the retracted position 21B, the second cutter blade 22 is positioned at the separated position 22B. The first cutter blade moving mechanism 24 and the second cutter blade moving mechanism 25 are designed so that the first cutter blade 21 and the second cutter blade 22 move (displace) in association with each other in this manner.

Action of Force During Cutting Operation

Figure 5:
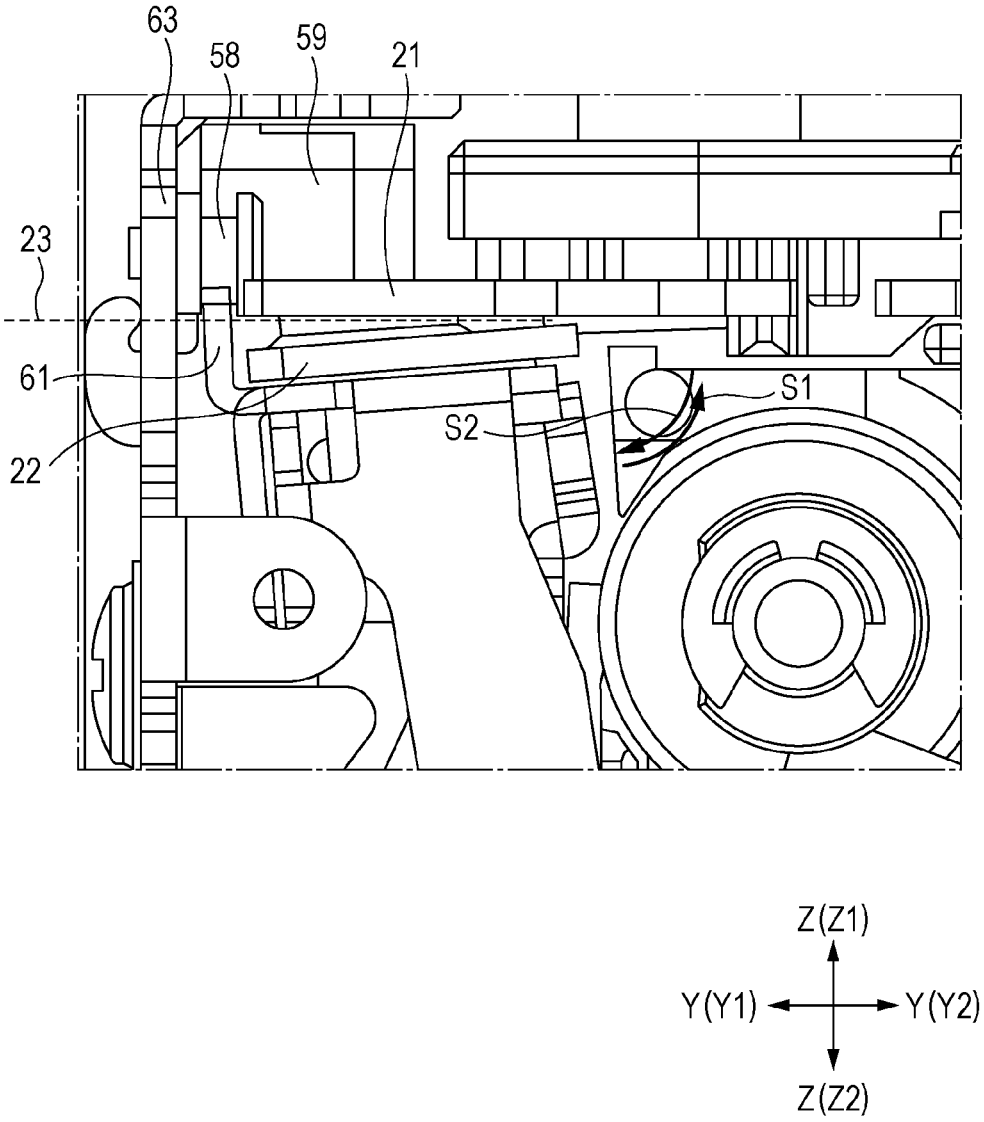
FIG. 5 is an enlarged side view of a periphery of a cutter blade.

FIG. 5 is an enlarged side view of a periphery of the cutter blade (first cutter blade 21 and the second cutter blade 22). In FIG. 5, a state where the first cutter blade 21 is positioned at the advancing position 21A is illustrated. As described above, the second cutter blade 22 is fixed to the cutter support portion 61 of the support frame 29 and the upper end of front end portion of the cutter support portion 61 is inserted between the collars of the stopper member 58. The stopper member 58 is fixed to the body frame 63. In addition, the second cutter blade 22 is biased by the coil spring 59 upward Z1. The second cutter blade 22 receives a rotational force in the direction of the arrow S1 by the bias. During cutting the recording paper 3, the first cutter blade 21 moves from the retracted position 21B forward Y1 along the moving surface 23 and reaches the advancing position 21A.

Figure 6:
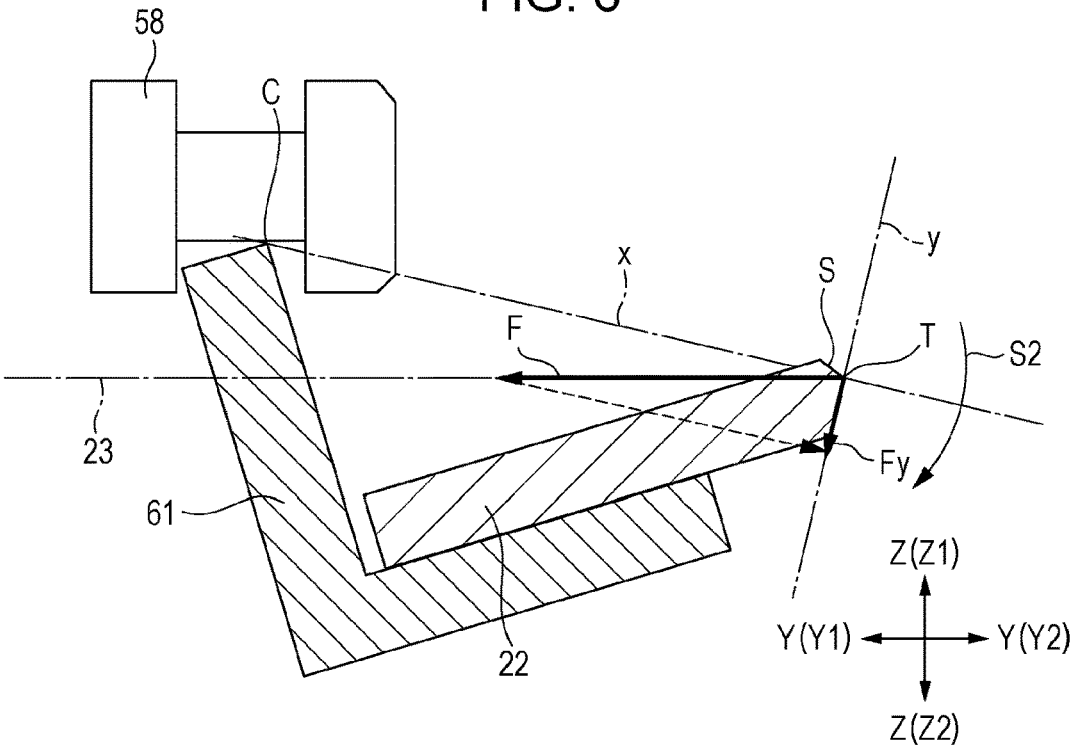
FIG. 6 is a view for explaining an action of a force during cutting.

FIG. 6 is a view for explaining an action of a force during cutting. In FIG. 6, the second cutter blade 22, the cutter support portion 61, and the stopper member 58 are schematically illustrated. The second cutter blade 22 and the cutter support portion 61 which are fixed to each other can rotate (swing) about the rotation center C (swing center, swing fulcrum, swig axis). Moreover, from the condition structure of the cutter support portion 61 and the stopper member 58, the rotation of the cutter support portion 61 is different from a case where a rotation axis is provided, and becomes a rotation in which the position of the rotation center C slightly moves. That is, in the embodiment, as illustrated in FIG. 6, since a tip end portion of the cutter support portion 61 abutting against the stopper member 58 is the rotation center C, this is a case where the tip end portion (abutting position) moves in the Y direction as the cutter support portion 61 rotates.

During cutting, when the first cutter blade 21 which is not illustrated in FIG. 6 moves (moves from the retracted position 21B toward the advancing position 21A) in the Y1 direction along the moving surface 23, the blade edge 21*a* of the first cutter blade is in contact with (for example, contact with the vicinity of a tapered portion S of FIG. 6) the blade edge 22*a* of the second cutter blade.

In this case, normally, the blade edges 21*a* and 22*a* behave slidingly each other along the tapered portion S, and a force in a direction perpendicular to the tapered portion S acts on the second cutter blade 22. The force gives a rotational moment in a direction of the arrow S2 around the rotation center C with respect to the second cutter blade 22. Since the second cutter blade 22 is moved in a direction away from the first cutter blade 21 by the rotational moment, the blades 21 and 22 do not bite each other. The first cutter blade 21 moves along the moving surface 23 above (side in the Z1 direction) the second cutter blade 22.

On the other hand, when the blade edges 21*a* and 22*a* are in contact with each other, for example, in a case where the blade edges 21*a* and 22*a* do not behave slidingly each other due to a cause that the blade edge 21*a* of the first cutter blade is too sharp or the like, a case where a force in the movement direction of the first cutter blade 21 acts on the second cutter blade 22 may be considered. In the example illustrated in FIG. 6, a contact point (contact position) of the blade edges 21*a* and 22*a* with each other is represented by T and the force acting in the movement direction of the first cutter blade 21 is represented by F.

In this case, a component force Fy of the force F in a direction of a straight line y perpendicular to a straight line x connecting the rotation center C and the contact point T acts on the second cutter blade 22 as the rotational moment. Since the second cutter blade 22 is moved in a direction (separated position 22B side) away from the first cutter blade 21 by the rotational moment in the arrow S2 direction, the blades 21 and 22 do not bite each other.

The rotation center C of the second cutter blade 22 is positioned on the side of the first cutter blade 21 on the side in the Z1 direction of the moving surface 23 so that the action of the force is obtained. In other words, the rotation center C is positioned on the side of the first cutter blade 21 moving above (side in the Z1 direction) the second cutter blade 22 with the moving surface 23 as a boundary so that the behavior is obtained.

In addition, it is also possible to express that the rotation center C is provided on a side (side in the Z1 direction) opposite to the separated position 22B with respect to a position (T) in which the first cutter blade 21 moves in a direction toward the second cutter blade 22 and the blade edge 21*a* of the first cutter blade 21 abuts against the blade edge 22*a* of the second cutter blade 22 so that the behavior is obtained.

In addition, it is also possible to express that the rotation center C is provided on a side (side in the Z1 direction) in a direction toward the sliding contact position 22A from the separated position 22B with respect to a position (T) in which the first cutter blade 21 moves in a direction toward the second cutter blade 22 and the blade edge 21*a* of the first cutter blade 21 abuts against the blade edge 22*a* of the second cutter blade 22 so that the behavior is obtained.

Figure 7:
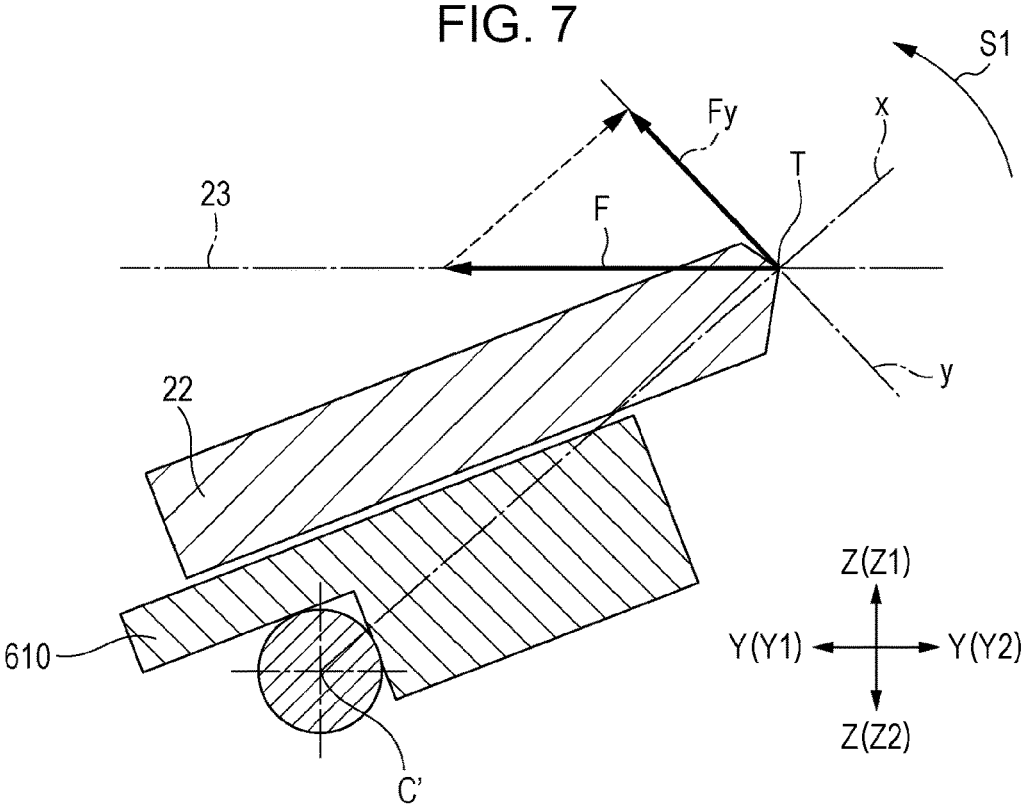
FIG. 7 is a view for explaining an action of a force during cutting in a comparative example.

FIG. 7 is a view for explaining an action of a force during cutting in a comparative example. FIG. 7 illustrates a comparative example in a case where a support structure of a second cutter blade different from that of the embodiment is adopted. Specifically, a cutter support portion 610 (corresponding to the cutter support portion 61 of the embodiment) and a rotation axis C' (corresponding to the rotation center C of the embodiment) are different and in this case, the rotation axis (rotation center) C' of the second cutter blade 22 is positioned below (side in the Z2 direction) the moving surface 23 of the first cutter blade 21. In other words, the rotation center C' is positioned on a second cutter blade 22 side with the moving surface 23 as a boundary.

In the configuration of such a comparative example, when the blade edges 21*a* and 22*a* are in contact with each other, similar to the case described in FIG. 6, a case where a force F in the direction of the moving surface 23 occurs will be examined. As illustrated in FIG. 7, a component force Fy of the force F in a direction of a straight line y perpendicular to a straight line x connecting the rotation center C' and the contact point T acts on the second cutter blade 22 as the rotational moment in an arrow S1 direction. In this case, a force moving in a direction approaching the first cutter blade 21 acts on the second cutter blade 22 and there is a concern that the blades 21 and 22 bite each other.

Moreover, in the printer 1, the rotatable support structure of the second cutter blade 22 is configured by the cutter support portion 61 and the stopper member 58, but as long as the position of the rotation center C of the second cutter blade 22 is on the side of the first cutter blade 21 with the moving surface 23 as the boundary, another configuration may be provided. In addition, the rotation center C of the second cutter blade 22 may be provided at a position at which the second cutter blade 22 can be moved toward the separated position 22B by the force acting on the second cutter blade 22 when the first cutter blade 21 moves in the direction toward the second cutter blade 22 and the blade portion 21*b* (blade edge 21*a*) of the first cutter blade 21 abuts against the blade portion 22*b* (blade edge 22*a*) of the second cutter blade 22.

As described above, in the cutter 15 of the printer 1 according to the embodiment, even if the force of the first cutter blade 21 in the moving direction acts on the second cutter blade 22 when the first cutter blade 21 is in contact with the second cutter blade 22 (during cutting of the recording paper 3 or the like) due to a cause that the blade edge is too sharp, the rotational moment acts on the second cutter blade 22 in the direction away from the first cutter blade 21, and the second cutter blade 22 and the first cutter blade 21 do not bite each other (do not lock) by the position of the rotation center C.

Furthermore, since the first cutter blade 21 and the second cutter blade 22 do not bite each other, it is possible to make the blade edges 21*a* and 22*a* sharp and to make the cutter 15 cut well.

In addition, during cutting of the recording paper 3, since the second cutter blade 22 is biased to the first cutter blade 21 side by the coil springs 59, it is possible to reliably cut the recording paper 3.

In addition, the rotatable (swingable) support structure of the second cutter blade 22 can be realized by a relatively simple structure, that is, the cutter support portion 61 and the stopper member 58.

In addition, the printer 1 can be used in two installation orientations that differ by substantially 90 degrees, which is highly convenient.

Moreover, although the printer 1 is a thermal type printer, the printer 1 is not limited to the printer and a printer adopting another printing method such as an ink jet method may be used.

In addition, the cutter 15 can also be applied to another apparatus other than the printer.

In addition, the cutter 15 may be a full-cut type cutter for cutting the recording paper 3 over the entire width, or may be a partial cut type cutter for cutting the recording paper 3 while leaving a part thereof.

In addition, in the embodiment, the coil springs (35 and 59) are used as the biasing member for biasing each of the cutter blades 21 and 22, but the biasing member may be any type of spring other than the coil spring, or may be an elastic member such as rubber.

The scope of protection of the invention is not limited to embodiment and extends to the invention described in the claims and equivalents thereof.

The entire disclosure of Japanese Patent Application No. 2016-128615, filed Jun. 29, 2016 is expressly incorporated by reference herein.

What is claimed is:

1. A printing apparatus comprising:

a cutter that includes a first blade and a second blade, wherein the second blade is rotatable about a rotation center, wherein the cutter cuts a printing medium by causing the first blade to be in frictional contact with the second blade, wherein the second blade is rotatable and is moved in response to the frictional contact;

wherein the first blade is positioned on a first blade side of the second blade when in the frictional contact, wherein the rotation center of the second blade is disposed on the first blade side with respect to a moving surface of the first blade.

2. The printing apparatus according to claim 1, wherein the second blade is biased in a direction in which the second blade is in contact with the first blade.

3. The printing apparatus according to claim 1, wherein the printing apparatus is capable of being installed in two orientations that differ by substantially 90 degrees.

4. A cutting device comprising:

a first blade and a second blade, wherein the first blade and the second blade are arranged to cut a medium by causing the first blade to be in frictional contact with the second blade, wherein the second blade rotates about a rotation center, wherein the first blade and is positioned on a first blade side of the second blade, wherein the rotation center of the second blade is disposed on the first blade side with respect to a moving surface of the first blade.

5. A cutting device comprising:

a first blade and a second blade, wherein the first blade and the second blade are configured to cut a sheet by causing the first blade to be in cooperation with the second blade by being moved with respect to the second blade, a support mechanism which supports the second blade such that the second blade is swingable between a first position in which a blade portion side of the second blade is in contact with the first blade and a second position in which the blade portion side of the second blade is away from the first blade, wherein a swing axis of the second blade is provided on a side opposite to the second position with respect to a position where the first blade moves in a direction toward the second blade and a blade portion of the first blade abuts against a blade portion of the second blade.

6. The cutting device according to claim 5, further comprising:

a moving mechanism that causes the first blade to reciprocate with a standby position as a starting point; and a displacement mechanism that positions the second blade at the first position during a forward movement of the first blade and positions the second blade at the second position during a rearward movement of the first blade.

7. The cutting device according to claim 6, wherein the support mechanism includes a biasing member that biases the second blade toward the first position, and wherein the displacement mechanism positions the second blade at the first position by a biasing force of the biasing member during the forward movement of the first blade and positions the second blade at the second position against the biasing force of the biasing member during the rearward movement of the first blade.

8. The cutting device according to claim 7, wherein the displacement mechanism includes a cam provided on a part of the moving mechanism causing the first blade to reciprocate, and a cam follower provided on a part of the support mechanism supporting the second blade, and wherein the second blade is positioned at the second position by the cam and the cam follower.

9. The cutting device according to claim 6, further comprising:

a first blade biasing member that biases the first blade toward the standby position.

10. A printing apparatus that performs printing on continuous paper, the apparatus comprising:

the cutting device according to claim 5;

wherein the continuous paper is cut by the cutting device.

* * * * *